US005134908A

United States Patent [19]

Fisher

[11] Patent Number: 5,134,908

[45] Date of Patent: Aug. 4, 1992

[54] ADJUSTABLE JAW TYPE PLIER WITH HAND PROTECTING OVER TRAVEL LIMIT

[75] Inventor: George F. Fisher, Hadley, Pa.

[73] Assignee: Channellock, Inc., Meadville, Pa.

[21] Appl. No.: 673,938

[22] Filed: Mar. 22, 1991

[51] Int. Cl.[5] ..... B25B 7/04

[52] U.S. Cl. ..... 81/414

[58] Field of Search ..... 81/407, 413–415

[56] References Cited

U.S. PATENT DOCUMENTS 844,886 2/1907 Morris ..... 81/407

4,271,732 6/1981 Vaughan ..... 81/414

*Primary Examiner*—James G. Smith

*Attorney, Agent, or Firm*—Lackenbach Siegel Marzullo & Aronson

[57] ABSTRACT

Adjustable jaw plier tool having crossed pivotably engaged handles one of which is slotted, and one of which has an affixed pivot pin. An integral over travel element is positioned on the rearward portion of the working surface of the jaw of the handle having the affixed pivot pin to avoid the possibility of hand injury by bearing against an elongate portion of the slotted handle.

5 Claims, 4 Drawing Sheets

ADJUSTABLE JAW TYPE PLIER WITH HAND PROTECTING OVER TRAVEL LIMIT

BACKGROUND OF THE INVENTION

The present invention relates to an adjustable plier jaw-type of the kind disclosed in the U.S. Pat. No. 2,592,927— Manning, wherein the jaws can be selectively adjusted to a variety of preset positions; more particularly, the present invention is directed to an improvement in such jaw-type plier tools which eliminates the possibility of injury to the hand of the tool user on account of over travel of the pivoted crossed handles of the tool.

The problem of the possibility of a crushing hand injury in the course of using adjustable jaw-type pliers has been recognized in U.S. Pat. No. 4,271,732 and the solution presented in this patent is the inclusion of an integral raised over travel stop on the jaw handle of the tool which carries the fixed pivot pin. The aforedescribed over travel stop is effective in avoiding crushing injury, but requires substantial reshaping of the jaw handle, with which it is integral, in order to provide a stop of sufficient mass to have the strength to remain unaffected by repeated use.

SUMMARY OF THE INVENTION

The improved adjustable jaw-type plier tool of the present invention is provided with an over travel limiting element in the form of a relatively small, integral extension of the rear portion of the jaw means of the tool handle that is provided with a pivot pin. The relatively small integral extension of the jaw means closely abuts, but does not bear against, the opposing edge of the other tool handle when the jaws of the tool are in contact and there is no danger of a crushing injury. However, the integral extension of the jaw means is in bearing contact with the opposing edge of the other, slotted, tool handle for all open jaw positions so that the hand of the tool user is at all times protected from injury for all open jaw positions.

DESCRIPTION OF THE PREFERRED EMBODIMENTS

Figure 1:
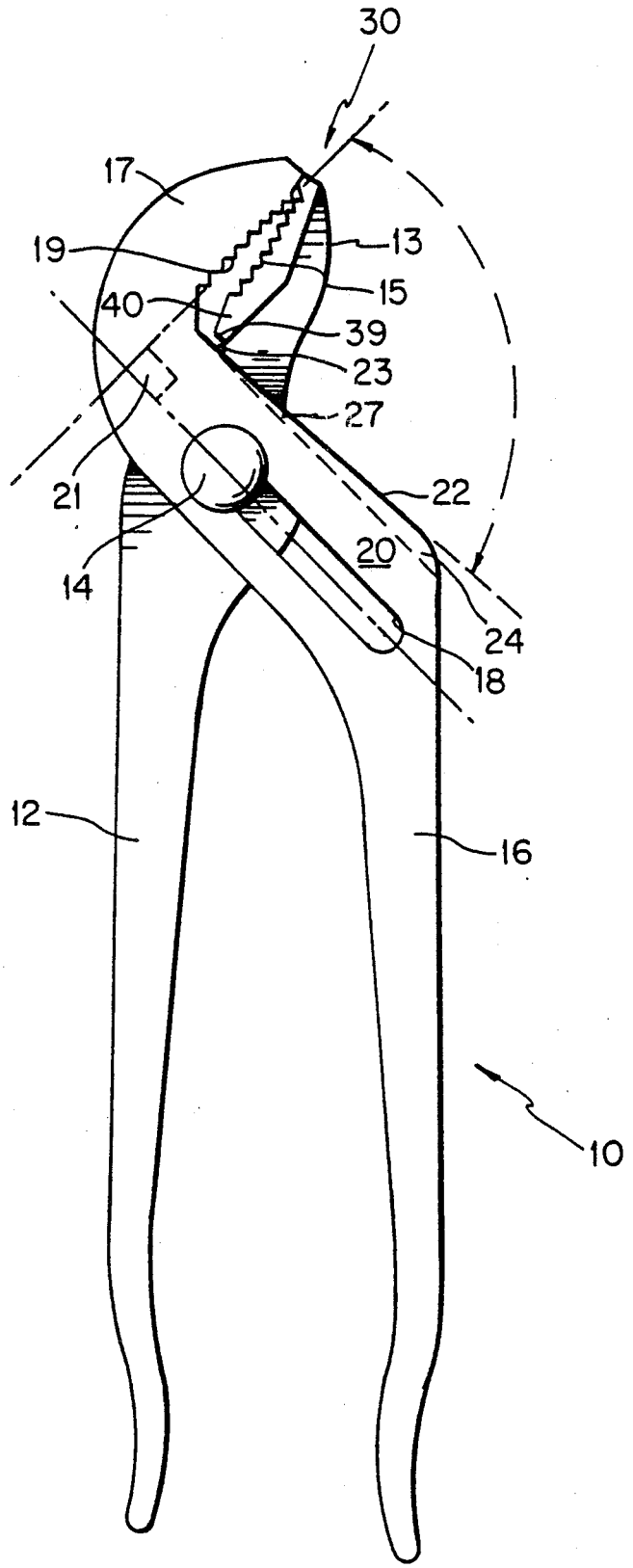
FIG. 1 is a top plan view of the improved jaw plier tool of the present in the closed position.

With reference to the drawing, an adjustable jaw type plier is shown at 10 having first handle means 12 on which is mounted pivot pin means 14 which engages second handle means 16 at rectangular slot 18 thereof. First handle means 12 is provided with integral first jaw means 13 and second handle means 16 is provided with integral second jaw means 17 which have working surfaces 15, 19 which are opposed when the tool is in use.

The slot 18 in the elongate portion 20 of the second handle means 16 extends away from second jaw means

17 at right angle to the working surface 19 of second jaw means 17 as indicated at 21 while the edge 22 of elongate portion 20 extends away from the working surface 19 at an angle which is slightly less, e.g. by 2–5 degrees angular increment, than 90 degrees as indicated at 27. This configuration in effect provides an integral shim portion 24 on the elongate portion 20 which slopes upwardly away from working surface 19 of second jaw means 17. The tongue and groove arrangement comprising tongue element 26 of first jaw handle 12 and groove elements 28 of second jaw handle 16, in cooperation with slot 18, and loosely engaged pin pivot means 14, enables adjustment of the plier to various settings from the jaw contacting position of 30 in FIG. 1 to the fully open position 32 in FIG. 2 and a plurality of intermediate positions such as indicated at 34 in FIGS. 2 and 3, and as described in U.S. Pat. No. 2,592,927 and also in U.S. Pat. No. 4,271,732.

Figure 2:
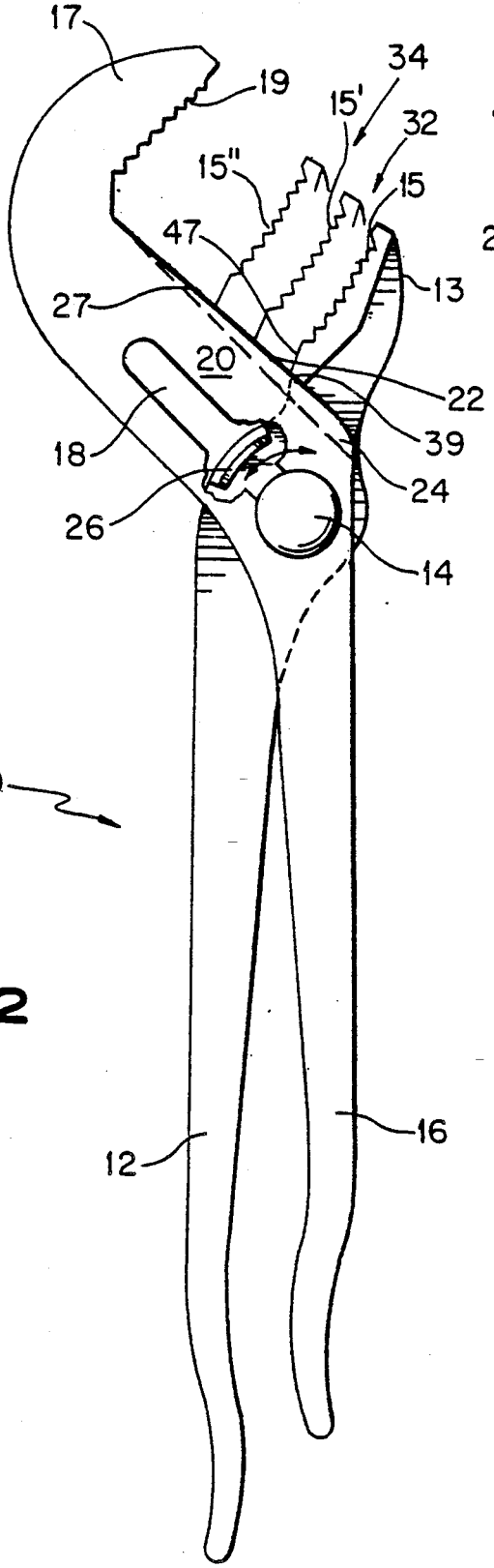
FIG. 2 is a top plan view of the improved jaw plier tool of the present invention adjusted to a fully open position.
Figure 2A:
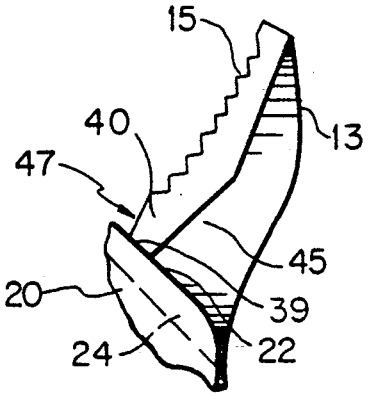
Figure 3:
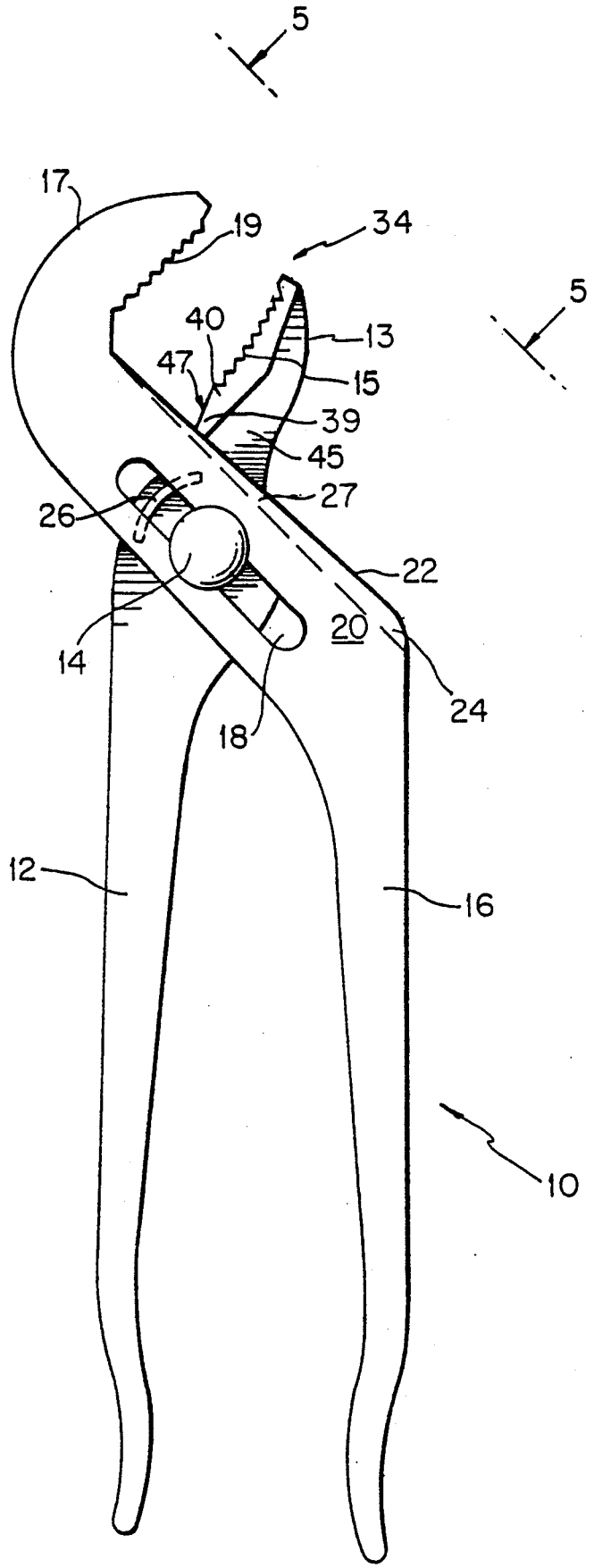
FIG. 3 is a top plan view of the improved jaw plier tool of the present invention adjusted to an intermediate position.
Figure 4:
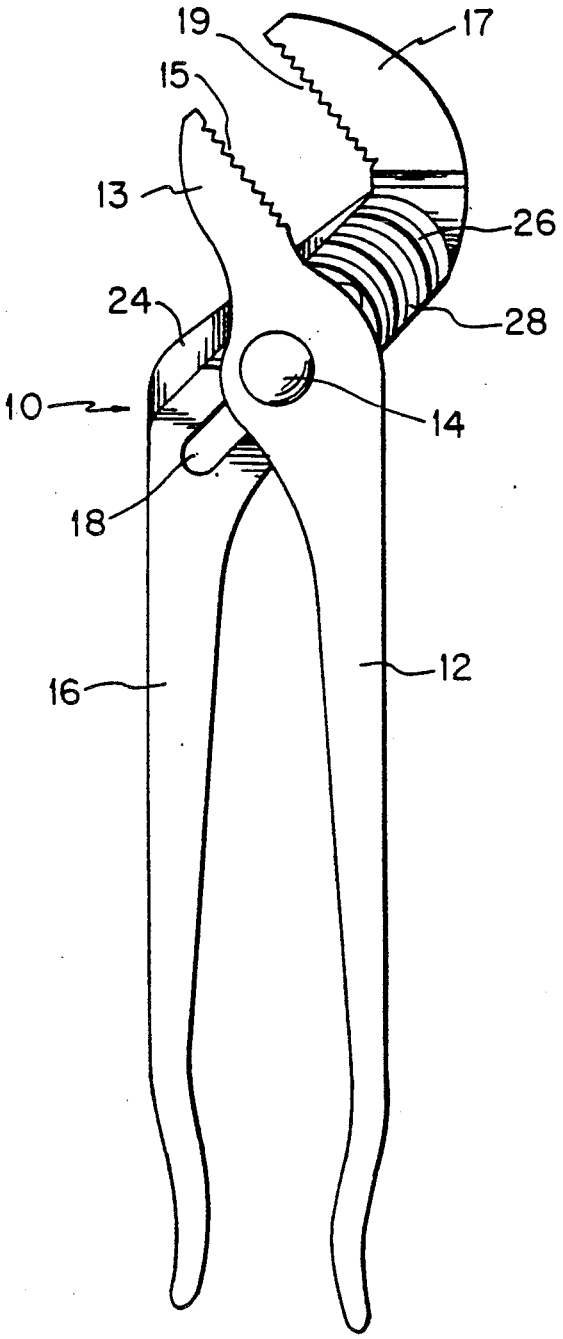
FIG. 4 is a bottom plan view of the tool of FIG. 3.

In all such open jaw positions, the terminal surface 39 of over travel element 40, which is an integral rearward extension of the working surface 15 of the first jaw means 13, bears against the shim portion 24 of edge 22 of elongate portion 20, halting movement of tongue element 27 in groove arrangement 28, and the positions of the working surfaces 15, 15', 15'' of the first jaw means 13 are substantially parallel and consistently positioned for all open jaw positions as indicated in FIG. 2. For the closed jaw position 30, in FIG. 1, where over travel is prevented by the jaws 13, 17, over travel element 40 closely abuts, but does not bear against edge 22 as indicated at 23. Thus, for all operating positions, at least a predetermined minimum space is maintained between the first handle means 12 and second handle means 16 to provide a safeguard against crushing injuries.

Figure 5:
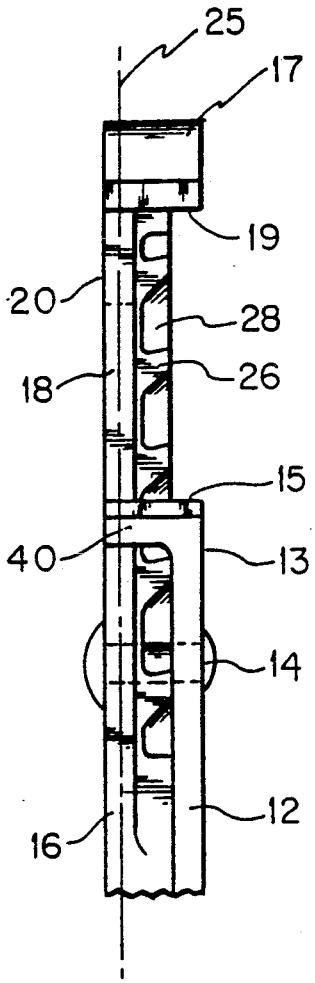
FIG. 5 is in a partial elevation view taken at 5—5 of FIG. 3.

With further reference to the drawings, it can be seen that for the embodiment disclosed, integral over travel element 40 tapers and narrows toward the portion thereof closely abutting the edge 22 of elongate portion 20 and the terminal surface 39 of integral over travel element 40 is substantially parallel to the adjacent edge 22 of elongate portion 20 and perpendicular to the flat surface 45 on the tapered extension 47. Further, as can be seen in FIG. 5, the opposed working surfaces 15, 19 and integral over travel element 40 are at least partly in-line with the elongate portion 20 or indicated at 25.

Although the present invention has been described in some detail by way of illustration and example for purposes of clarity and understanding, it will, of course, be understood that various changes and modifications may be made in the form, details, and arrangements of the parts without departing from the scope of the invention as set forth in the following claims.

What is claimed is:

1. An adjustable jaw plier comprising:

first handle means;

first jaw means connected to said first handle means, second handle means;

second jaw means connected to said second handle means, said first and second jaw means having respective oppositely positionable working surfaces;

a pivot pin means mounted on said first jaw means;

an adjustable arcuate tongue and groove means incorporated within the first and second jaw means, spaced from and concentric with the pivot pin means which are operable to establish a plurality of open jaw positions with different spacing between said working surfaces, said second handle means having an elongate portion with an edge extending away from said second jaw means at an angle to its working surface which is less than a right angle by a small angular increment, said elongate portion joining said second jaw and handle means and having a slot extending substantially at a right angle to the working surface of said second jaw means for receiving said pivot pin means for adjusting said tongue and groove means;

an over travel limiting element for limiting overtravel of the first jaw means for said open jaw positions to maintain a predetermined minimum space between the first and second handle means, said overtravel element being in the form of an integral extension of the first jaw means which extends toward and closely abuts said edge of said elongate portion in the closed jaw position with said first and second jaw means in contact, and which is in bearing contact engagement with said edge of said elongate portion for all open jaw positions, including the fully open jaw position, said small angular increment being such that the working surfaces of said first and second jaw means are substantially parallel for all open jaw positions.

2. Apparatus in accordance with claim 1, wherein said over travel element is in the form of an integral extension of said first jaw means at the portion thereof closely abutting said adjacent edge of said elongate portion in the closed jaw position and has a bearing surface substantially parallel to said adjacent edge in said closed jaw position.

3. Apparatus in accordance with claim 2, wherein said integral extension is tapered and narrows toward the portion thereof closely abutting said adjacent edge of said elongate portion in said closed jaw position.

4. Apparatus in accordance with claim 3, wherein a flat surface is provided on the tapered extension remote from the work surface of the first jaw means, said surface being substantially perpendicular to the bearing surface of said extension.

5. Apparatus in accordance with claim 1, wherein said working surfaces and said over travel element are at least in part in-line with said elongate portion.

* * * * *